US007323978B2

(12) United States Patent
Parker et al.

(10) Patent No.: US 7,323,978 B2
(45) **Date of Patent: *Jan. 29, 2008**

(54) FALSE ALARM REDUCTION METHOD AND SYSTEM

(75) Inventors: James Parker, Temple City, CA (US); Randall Wang, Temple City, CA (US)

(73) Assignee: EE Systems Group Inc., Temple City, CA (US)

( * ) Notice: Subject to any disclaimer, the term of this patent is extended or adjusted under 35 U.S.C. 154(b) by 366 days.

This patent is subject to a terminal disclaimer.

(21) Appl. No.: 11/059,917

(22) Filed: Feb. 16, 2005

(65) Prior Publication Data

US 2006/0192666 A1 Aug. 31, 2006

(51) Int. Cl.
*G08B 29/00* (2006.01)

(52) U.S. Cl. ..... 340/507; 340/506; 340/524; 340/525; 340/825.36; 340/825.49; 340/3.1

(58) Field of Classification Search ..... 340/506, 340/507, 524, 525, 825.36, 825.49, 3.1
See application file for complete search history.

(56) References Cited

U.S. PATENT DOCUMENTS 4,833,449 A * 5/1989 Gaffigan ..... 340/505
4,857,912 A * 8/1989 Everett et al. ..... 340/508
5,736,927 A * 4/1998 Stebbins et al. ..... 340/506
6,084,509 A * 7/2000 Simpson, Sr. ..... 340/506
6,137,411 A * 10/2000 Tyren ..... 340/572.1

* cited by examiner

*Primary Examiner*—Daryl C Pope
(74) *Attorney, Agent, or Firm*—Raymond Y. Chan; David and Raymond Patent Group

(57) ABSTRACT

A digital verification control, which is incorporated with an alarm system, includes a first timer device for presetting a single zone verification time in the control panel and second timer device for presetting a multiple zone verification time in the control panel. The single zone verification time is a single detector time delay and arranged when one of the sensors detects at least two triggered signals in the respective detecting area within the single zone verification time, the local warning system is activated for producing a local warning signal. The multiple zone verification time, which is longer than the single zone verification time, is a multiple detector time delay and arranged when the two sensors detect two triggered signals in the detecting areas respectively within the multiple zone verification time, the local warning system is activated for producing the local warning signal.

22 Claims, 14 Drawing Sheets

FALSE ALARM REDUCTION METHOD AND SYSTEM

BACKGROUND OF THE PRESENT INVENTION

1. Field of Invention

The present invention relates to alarm systems, and more particularly to a false alarm reduction method and system adapted for equipping with all common kinds of alarm system for minimizing the possibility of false alarm thereof.

2. Description of Related Arts

As the security industry has grown so has the false alarm problem. Currently many cities estimate 98% of their alarm response calls are false. More than 90% of the triggered alarms are false alarms caused by the detection as PIR sensors. This creates many problems (fines, manpower, time) not just for the local police department but for the alarm companies as well and especially the end user whether it is business or residential.

False alarms are the unsolved troubles to both the alarm companies and the police resources. Most alarm system owners have the unpleasant experience of being awaken in mid-night by the alarm company due to false alarms. Also, the police resources have suffered in waste of great amount of time and police force. Before the policemen arrive at the scene, no one knows whether it is a false alarm or an actual alarm. It creates a great burden to the limited police force in every city. The fines being levied to the end user can be hundreds of dollars and the local police department may not respond after two false alarms in one calendar year.

The triggering of false alarms may frequently be caused by insects such as spiders and cockroach entering the covering area of a PIR sensor, by the activity of animals such as birds, rats, and pets inside the PIR sensor covering area, and even by vehicle headlight and weather thunder. It is because the detection ability of PIR sensor does not contain any verification capability like human beings.

According to statistics, there are approximately 32.3 million to 35.5 million false alarm activations per year. The vast majority of alarm calls, between 94-98%, are false and approximately US$1.3 billion in annual costs are due to false alarms. In fact, reliability of alarms, if measured using false alarm rates, is generally between 2-6% only.

False alarms account for 10-25% of all calls to police. Each false alarm requires approximately 20 minutes of police time of usually two officers. Currently, between 21 and 24 million security alarm systems are in the US and approximately 18 million of which are monitored. One out of every seven U.S. businesses and one of every nine U.S. residences have alarms. Some industry estimates suggest that 1.5 million new alarms are installed annually. Solving the problem of false alarms would relieve 35,000 officers from providing what many sees as an essentially private service.

In fact, millions of expenses have been wasted for the police resources in responding to the false alarms, that greatly degrades the efficiency and performance of the police. Accordingly, some of the police stations in this country consider abandoning such alarm response service. It will only be good news to all burglars and criminals.

Therefore, how to effectively minimize the possibility of false alarm is an urgent topic to both the alarm users and the police resources. The question is what technologies are available to help prevent and reduce false alarms in both residential and commercial applications. What is an easy to use and a cost effective method of preventing false alarms?

SUMMARY OF THE PRESENT INVENTION

A main object of the present invention is to provide a false alarm reduction method and system thereof for reducing false alarm of security alarm system in order to effectively minimize the possibility of false alarm and substantially prevent the waste of police force.

A further object of the present invention is to provide a false alarm reduction method and system adapted for equipping with the security alarm system that renders the security alarm system becoming an intelligence system to avoid false alarm, wherein on complicate and expensive device is needed to install in the original security alarm system so as to prevent the unreasonable increase of the installation expense of the alarm owner.

Another object of the present invention is to provide a false alarm reduction method and system adapted to additionally incorporate with all kinds of currently installed security alarm system, including the closed loops, EOL (single end of line resistor loops) and DEOL (double end of line resistor loops) alarm systems, so that the alarm owner does not need to purchase or replace another new set of alarm system.

Another object of the present invention is to provide a false alarm reduction method and system for security alarm system, which can avoid false alarm without the manual operation by the central station and the monitoring by the additional video and/or video verification equipments.

Another object of the present invention is to provide a false alarm reduction method and system which can be installed to an existing security alarm system in a rapid and quick method of simply adding a terminal connection per zone to the existing monitoring zone inputs on the alarm control panel or zone expander. In other words, no circuit connection of the original installed security alarm system has to be changed or reconnected.

Another object of the present invention is to provide a false alarm reduction method and system for security alarm system, wherein a voltage monitoring loop is T-tapped to each monitoring zone via the existing monitoring zone input on the alarm control panel or zone expander to monitor the impedance on the connected T-Tap zone to determine the alarm/restore state of the entire monitoring loop. The monitoring loop is typically connected to a motion detector so in essence the state of the motion detector (alarm or restore) is being monitored and other loop states such as a fault and trouble can also be monitored although no action is taken.

Another object of the present invention is to provide a false alarm reduction method and system which is capable of generating a wide range of voltages and presenting them individually on each monitoring zone connection, wherein the "voltage" when presented to the alarm control panel or zone expander can overdrive the natural or previously present voltage so as to allow the false alarm reduction system to present an alarm or restore state to the control panel regardless of the true condition of the monitoring zone (i.e. the motion detector output).

Another object of the present invention is to provide a false alarm reduction method and system which is capable of both determining the alarm/restore state of the monitoring zone (i.e. the motion detector) while simultaneously presenting independently different alarm or restore states to the alarm control panel.

Another object of the present invention is to provide a false alarm reduction method and system for a security alarm system, which has the ability to measure any interference signals, typically AC induction, that is being presented to the alarm control panel and the ability to generate voltages and inject them into the control panel, so that the false alarm reduction method and system is capable of monitoring and analyzing an interference signal and then generating an inverse signal that when injected will cancel out the original interference signal so as to dramatically reduce false alarms while improving reliability of the overall security alarm system.

Another object of the present invention is to provide a false alarm reduction method and system which not only effectively reduces or even eliminates false alarms generated by motion type sensors, shock sensors, GBC and contacts, etc. but also optimizes the security protection performance.

Another object of the present invention is to provide a false alarm reduction method and system for security alarm system, wherein the time frames of the single zone verification time and the multiple zone verification time can be preset through a verification control process so as to minimize the false alarm possibility without reducing the security protection.

Accordingly, in order to accomplish the above objects, the present invention provides a false alarm reduction method for a security alarm system having a control panel having a predetermined tolerance window of impedance change and one or more zone detectors, such as motion sensors shock sensors, opening contacts such as door/window switches, and carpet mat sensors, which are installed at different monitoring zones and electrically connected to the control panel in such a manner that when one of the zone detectors is triggered, a loop impedance of the triggered zone detector and the control panel changes from a normal/restore state impedance to an alarm state impedance which is different to the normal/restore state impedance for a predetermined value, wherein the false alarm reduction method comprises the steps of:

(a) generating and injecting an altered impedance which is within the predetermined tolerance window of the control panel to present a desired state to the control panel; and (b) monitoring any change of the loop impedance between a natural state impedance and an alarm state impedance for each of the zone detectors with respect to the control panel.

The false alarm reduction method further comprises the steps of:

(c) presenting a desired restore state to the control panel when the loop impedances of the zone detectors within the monitoring zones are each monitored as the natural state impedance;

(d) presenting the desired restore state to the control panel when the loop impedance of one of the zone detectors within the respective monitoring zone is monitored as the alarm state impedance; and (e) thereafter when the loop impedance of one of the other zone detectors is also monitored as the alarm state impedance within a predetermined period of time or at least one more zone detector within the respective monitoring zone is also monitored as the alarm state impedance within the predetermined period of time, presenting the desired alarm state to the control panel for alarm response such as activating a local warning system to produce warning signals and/or activating a communication system such as an internet or a phone dialing system to transmit digital signals to a central station for dispatching to a designated police resource.

The present invention also provides a false alarm reduction system for a security alarm system having a control panel and one or more zone detectors which are installed at different monitoring zones and electrically connected with the control panel, wherein the false alarm reduction system comprises:

means for determining whether each of the zone detectors is in a restore state or an alarm state, and means for simultaneously and independently asserting either a desired alarm state or a desired restore state to the control panel, wherein when each of the zone detectors is determined in the restore state, the control panel is asserted with the desired restore state, wherein when one of the zone detectors within the respective monitoring zone is determined in the alarm state every time, the control panel is asserted with the desired restore state, thereafter when one of the other zone detectors is also determined in the alarm state within a predetermined period of time or at least one more zone detector within the respective monitoring zone is also determined in the alarm state within the predetermined period of time, the control panel is asserted with the desired alarm state for alarm response such as activating a local warning system to produce warning signals and/or activating a communication system such as an internet or a phone dialing system to transmit digital signals to a central station for dispatching to a designated police resource.

These and other objectives, features, and advantages of the present invention will become apparent from the following detailed description, the accompanying drawings, and the appended claims.

DETAILED DESCRIPTION OF THE PREFERRED EMBODIMENT

Figure 1:
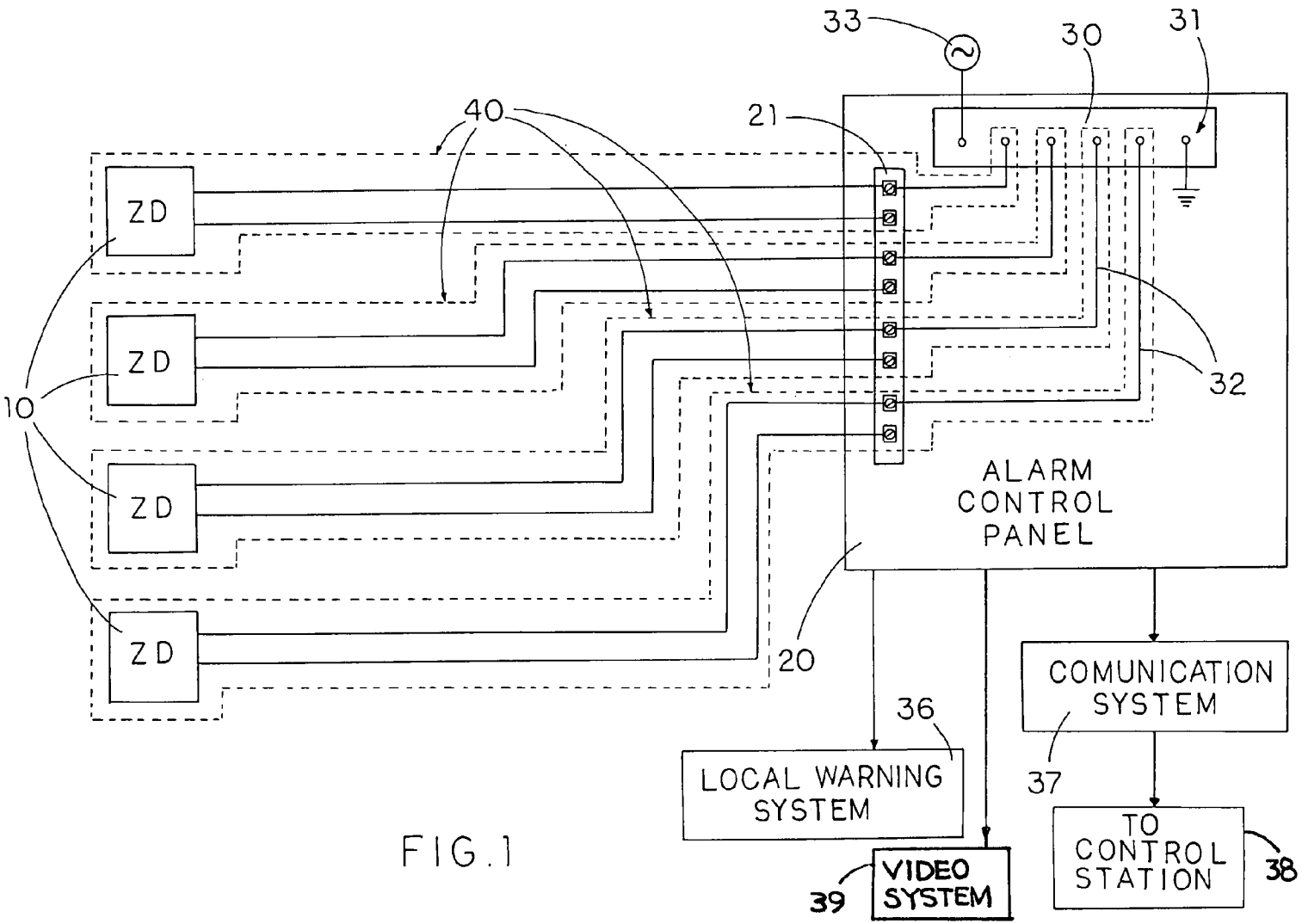
FIG. 1 is a schematic view illustrating a false alarm reduction system installed to a security alarm system according to a preferred embodiment of the present invention.

Referring to the drawings, the present invention provides a false alarm reduction (FAR) method and system thereof for security alarm system. Generally, a security alarm system comprises one or more zone detectors 10 electrically connected with the control panel 20, as shown in FIG. 1. The zone detectors 10 can be motion sensors, shock sensors, opening contacts such as door/window switches, or carpet mat sensors installed at different monitoring zones for detecting any motion occurred in such monitoring zones. The control panel 20 can be the main alarm control panel or a zone expander of the security alarm system according to the present invention. Each zone detector 10 for different monitoring zone has a pair of electric wires extended to the control panel 20 and connected to a pair of zone inputs 21 of the control panel 20 respectively.

The false alarm reduction (FAR) system 30 according to the preferred embodiment of the present invention can be installed to an existing security alarm system by simply tapping to the zone inputs 21 of the control panel without altering the circuit connection of the existing security alarm system. The FAR system 30 of the present invention enables a rapid and quick installation method of adding a connection wire per monitoring zone (zone detector) to the existing zone inputs 21 on the alarm control panel or expander 20. For example, four zone detectors 10 are respectively connected to four pairs of zone input 21 and the FAR system 30 includes six connections 31 for four connection wires 32 electrically connected to the four pairs of zone input 21 while another two connections being grounded and connected to power source 33. In other words, in accordance with the FAR method and system of the present invention, there is no need to cut any wires or change the circuit connection of the existing security alarm system. The user can simply unscrew and re-screw the corresponding zone inputs 21 so as to additionally connect the terminals of the connection wires 32 of the FAR system 30 thereto. Of course, for new installation of security alarm system, the FAR system 30 can be simply built in the alarm control panel or zone expander 20 so that when zone detectors 10 are connected to the zone inputs 21 of the control panel 20, they are already connected with the built-in FAR system 30.

There are several industry standard zone loop supervision standards. They are normally closed loops, single end of line resistor loops and double end of line resistor loops. In the case of the end of line resistors, they range in value from 1K to 5.6K ohms. For each loop supervision type the voltages presented to the control panel (alarm control panel or zone expander) 20 are different for the particular alarm and restore states. The FAR system is constructed to automatically determine which loop supervision configuration is being used and automatically self configure for it. This is done by logical determination based on measurement of the voltages presented to the zone inputs 21.

Figure 2A:
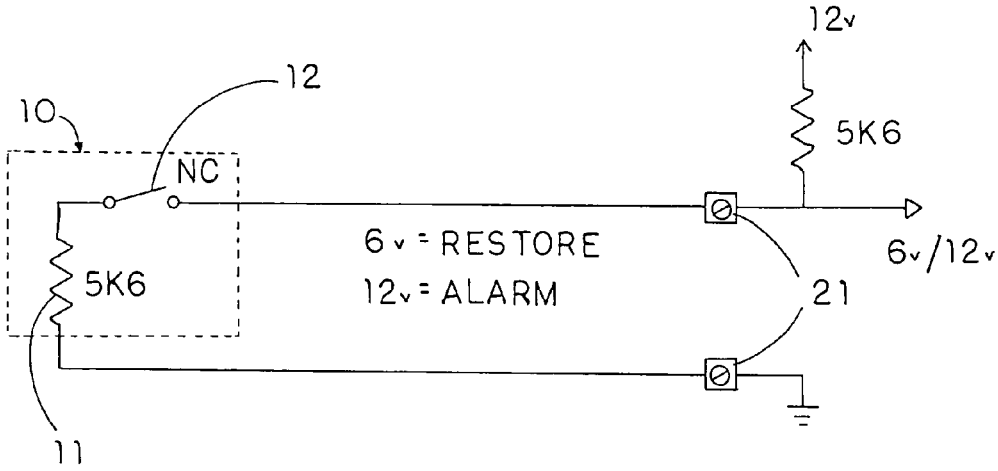
FIG. 2A is a schematic diagram of a single end of line resistor loop (EOL) of security alarm system.

A common EOL security alarm system is shown in FIG. 2A, wherein the zone detector 10 which is embodied as motion sensor comprises a resistor 11 and a normally closed switch 12 connected to a pair of zone inputs 21 of the control panel 20 to form the single end of line resistor loop (EOL zone loop) for the zone detector 10 with respect to the control panel 20. Typically, the EOL zone loop has a restore voltage set as half voltage (6V) and an alarm voltage set as full voltage (12V), that is when no motion is detected in the monitoring zone of the motion sensor 10, the loop voltage would be half voltage (6V) and the EOL zone loop is in a restore state, and that when a motion is detected, the normally closed switch 12 is triggered to open and will generally alter the loop voltage of the EOL zone loop to full voltage (12V), i.e. the EOL zone loop is in an alarm state that the control panel 20 will generally detect and respond correspondingly.

Figure 3A:
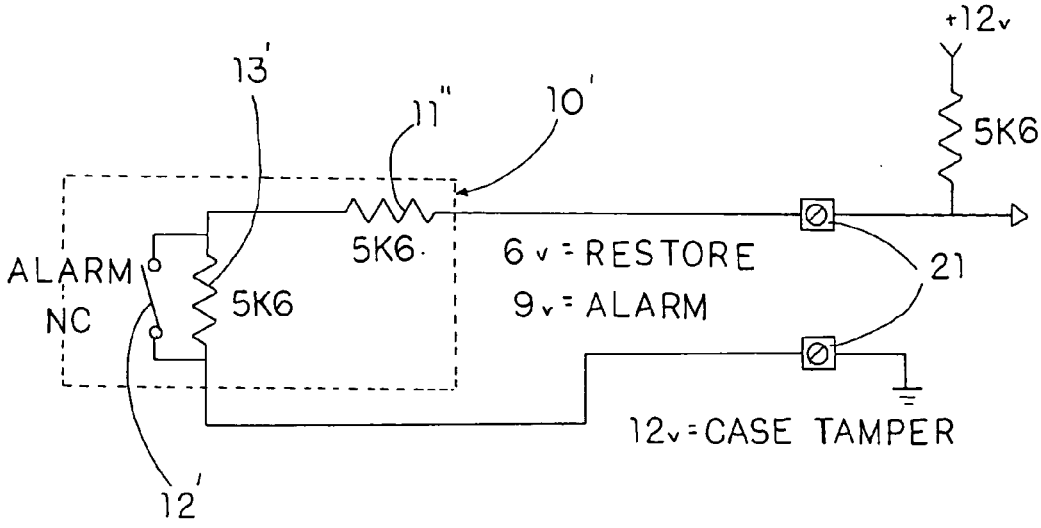
FIG. 3A is a schematic diagram of a double end of line (DEOL) resistor loop of security alarm system.

A common DEOL security alarm system is shown in FIG. 3A, wherein the zone detector 10' which is embodied as motion sensor comprises a first resistor 11', a normally closed switch 12' connected in series of the first resistor 11' and a second resistor 13' connected in parallel with the normally closed switch 12'. The zone detector 10' is connected to a pair of zone inputs 21 of the control panel 20 to form the double end of line resistor loop (DEOL zone loop) for the zone detector 10' with respect to the control panel 20. Typically, the DEOL zone loop has a restore voltage set as half voltage (6V), an alarm voltage set as ¾ voltage (9V) and a case tamper voltage set as full voltage (12V). That is when no motion is detected in the monitoring zone of the motion sensor 10, the loop voltage would be 6V and the DEOL zone loop is in a restore state. When a motion is detected, the normally closed switch 12 is triggered to open and will generally alter the loop voltage of the DEOL zone loop to 9V, i.e. the EOL zone loop is in an alarm state that the control panel 20 will generally detect and respond correspondingly. When the zone detector 10' is damaged, short of wire connection or the DEOL zone loop is broken or by-passed, the loop voltage of the DEOL zone loop is 12V and the DEOL zone loop is in a case tamper state.

Figure 2B:
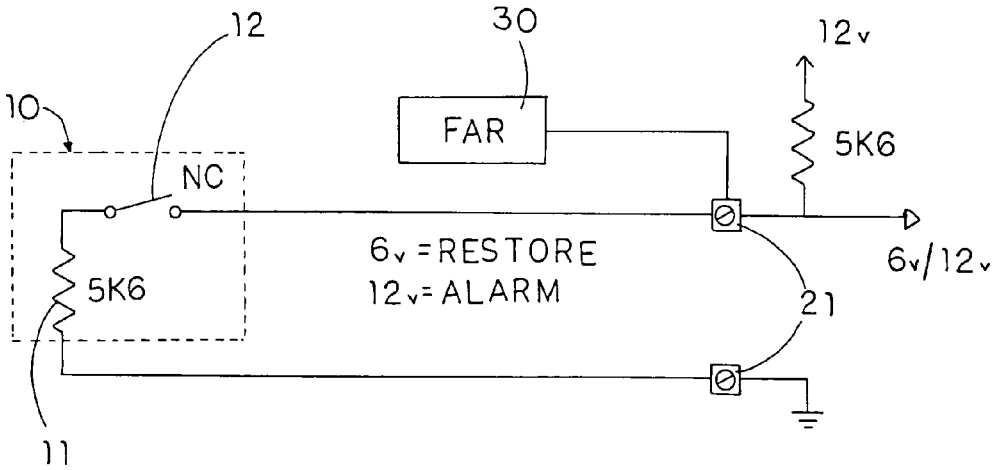
FIG. 2B is a schematic diagram of the single end of line resistor loop (EOL) of security alarm system equipped with the false alarm reduction system according to the above preferred embodiment of the present invention.
Figure 3B:
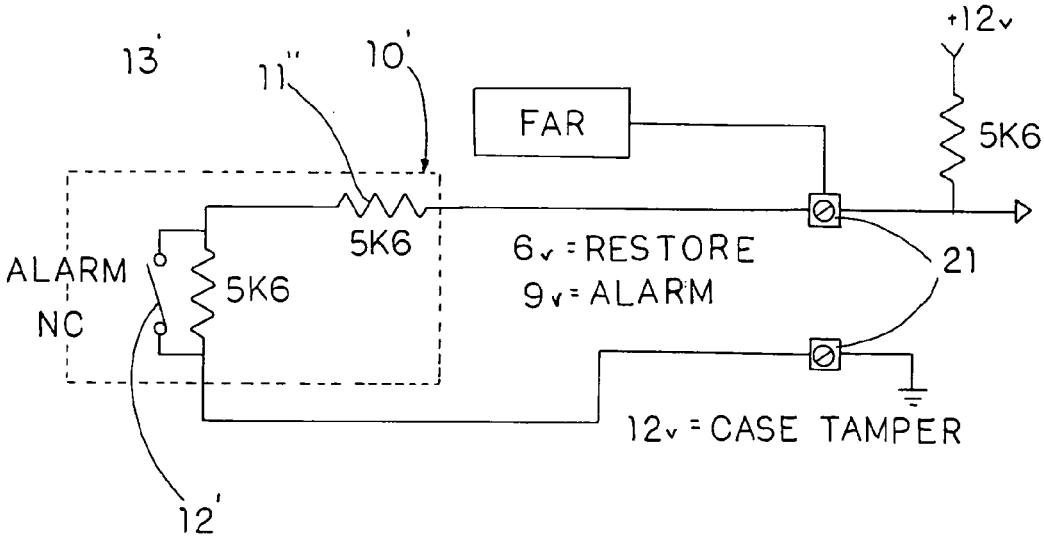
FIG. 3B is a schematic diagram of a double end of line (DEOL) resistor loop of security alarm system equipped with the false alarm reduction system according to the above preferred embodiment of the present invention.

In accordance with the preferred embodiment of the present invention, the FAR system 30 according to the preferred embodiment of the present as illustrated is T-tapped with the EOL zone loop or the DEOL zone loop, as shown in FIGS. 2B and 3B.

Figure 4A:
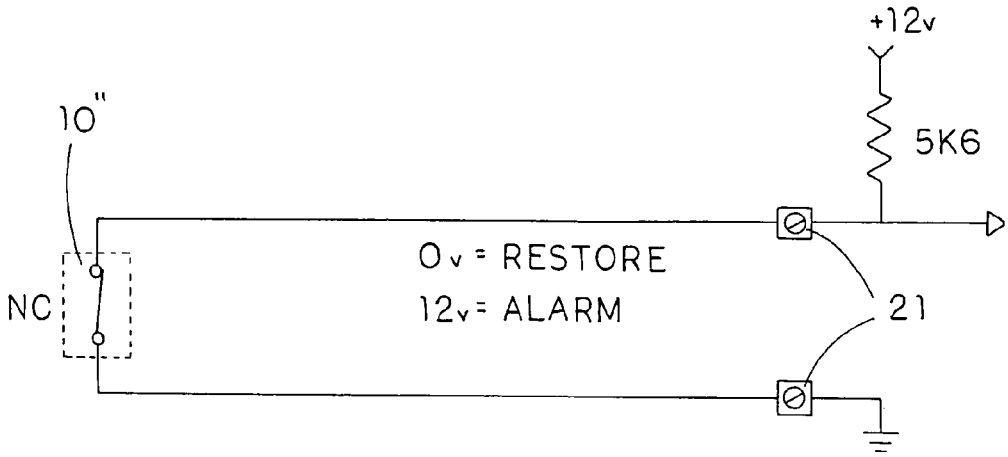
FIG. 4A is a schematic diagram of a closed loop of security alarm system.

Typically, the zone detector 10, 10' has one or more built-in resistor for connecting with the control panel in the EOL zone loop or the DEOL zone loop manner as shown in FIGS. 2A and 3A. However, some non-UL-approval zone detectors 10" contain no built-in resistor and such zone detector 10" will simply connect with the control panel 20 in a closed loop manner, as shown in FIG. 4A. The closed zone loop has a restore voltage set as 0V and an alarm voltage set as 12V, that is when no motion is detected in the monitoring zone of the motion sensor 10", the loop voltage would be 0V and the closed zone loop is in a restore state, and that when a motion is detected, the normally closed switch 12 is triggered to open and will generally alter the loop voltage of the closed zone loop to full voltage (12V), i.e. the EOL zone loop is in an alarm state that the control panel 20 will generally detect and respond correspondingly.

Figure 4B:
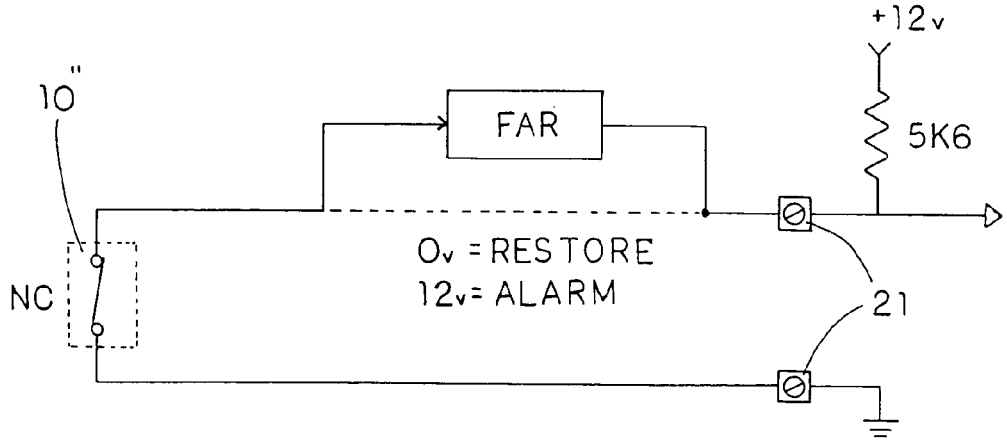
FIG. 4B is a schematic diagram of a closed loop of security alarm system equipped with the false alarm reduction system according to the above preferred embodiment of the present invention.
Figure 5A:
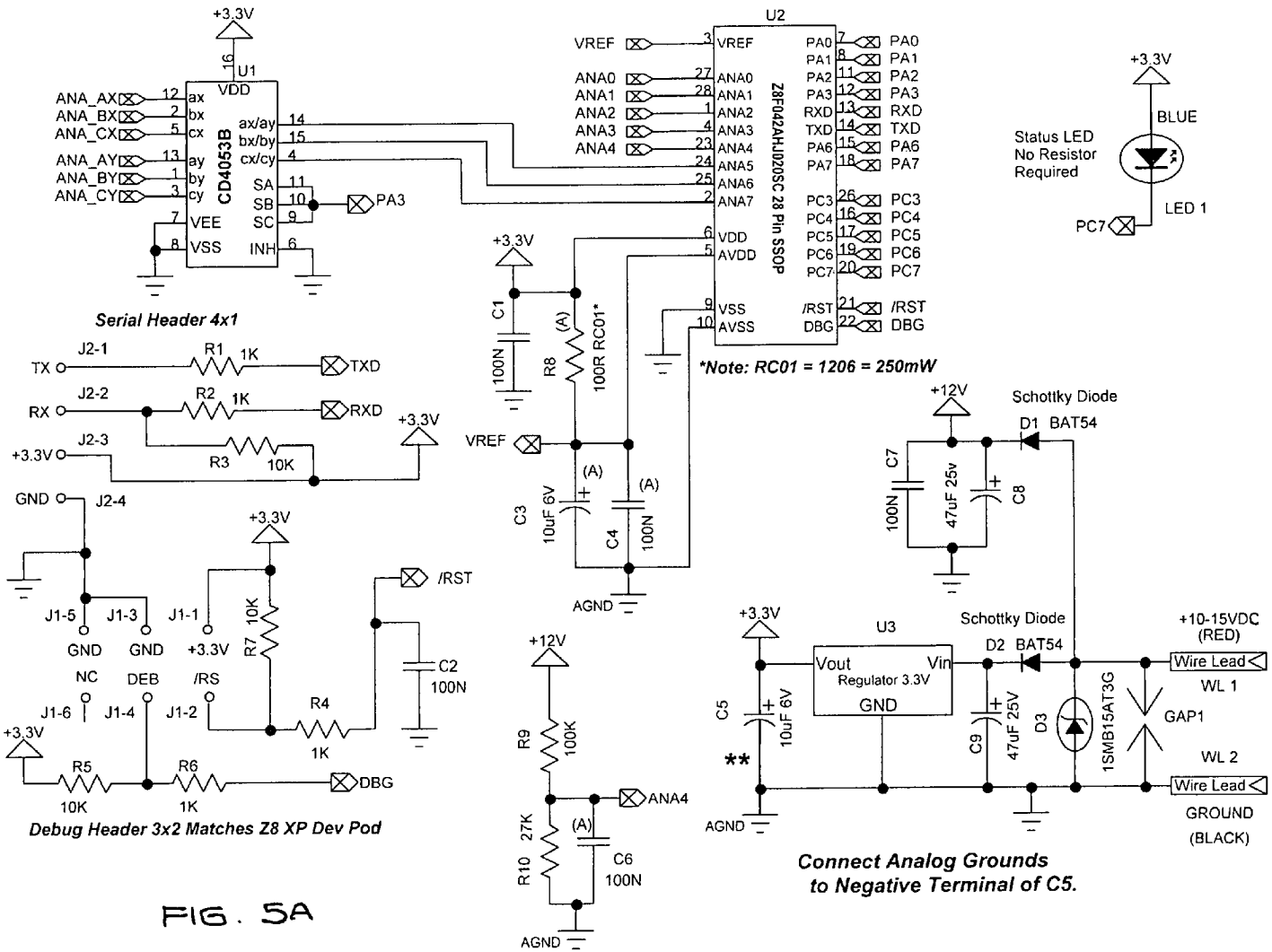
FIGS. 5A-5E are circuit diagrams of the false alarm reduction system according to the above preferred embodiment of the present invention.
Figure 5B:
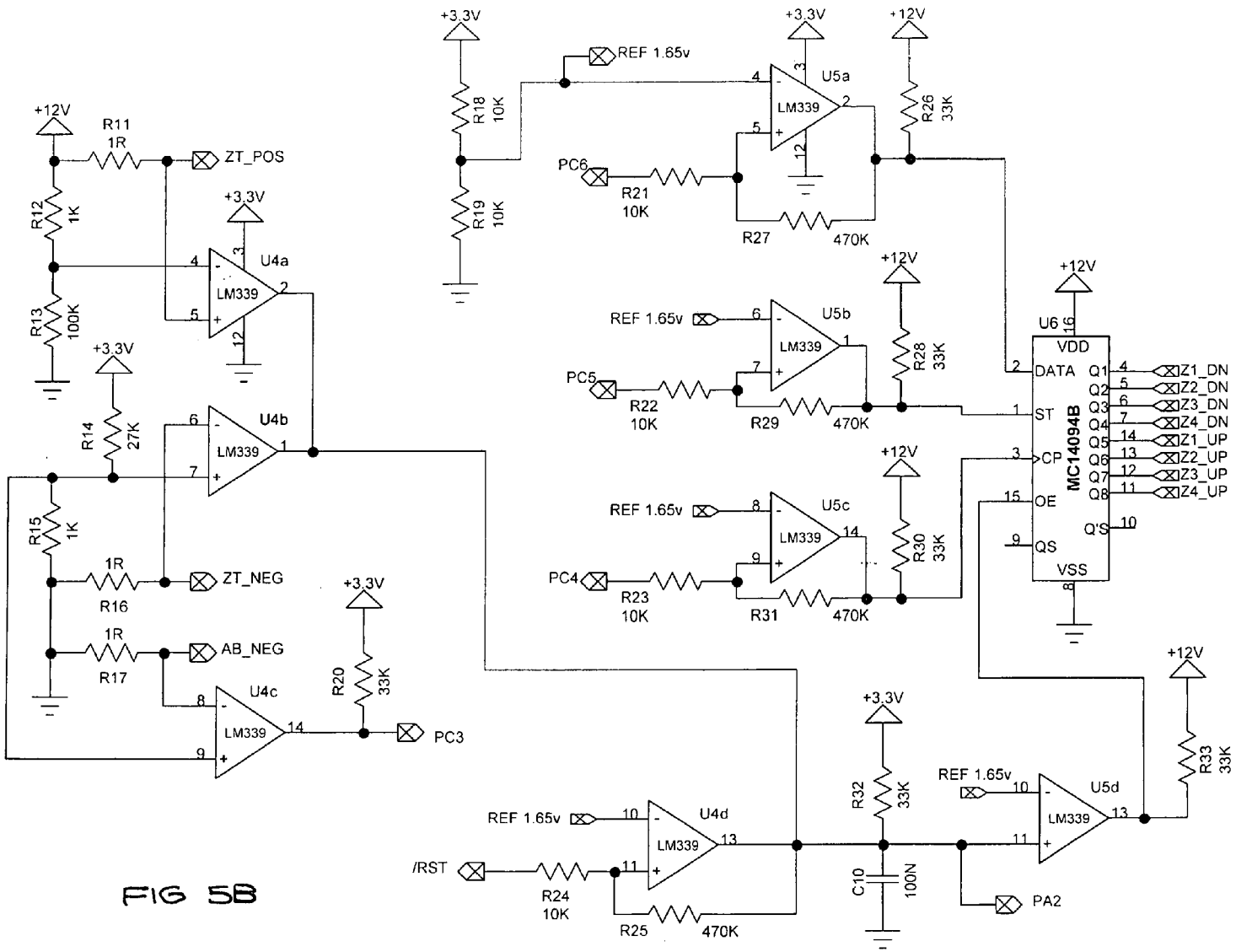
Figure 5C:
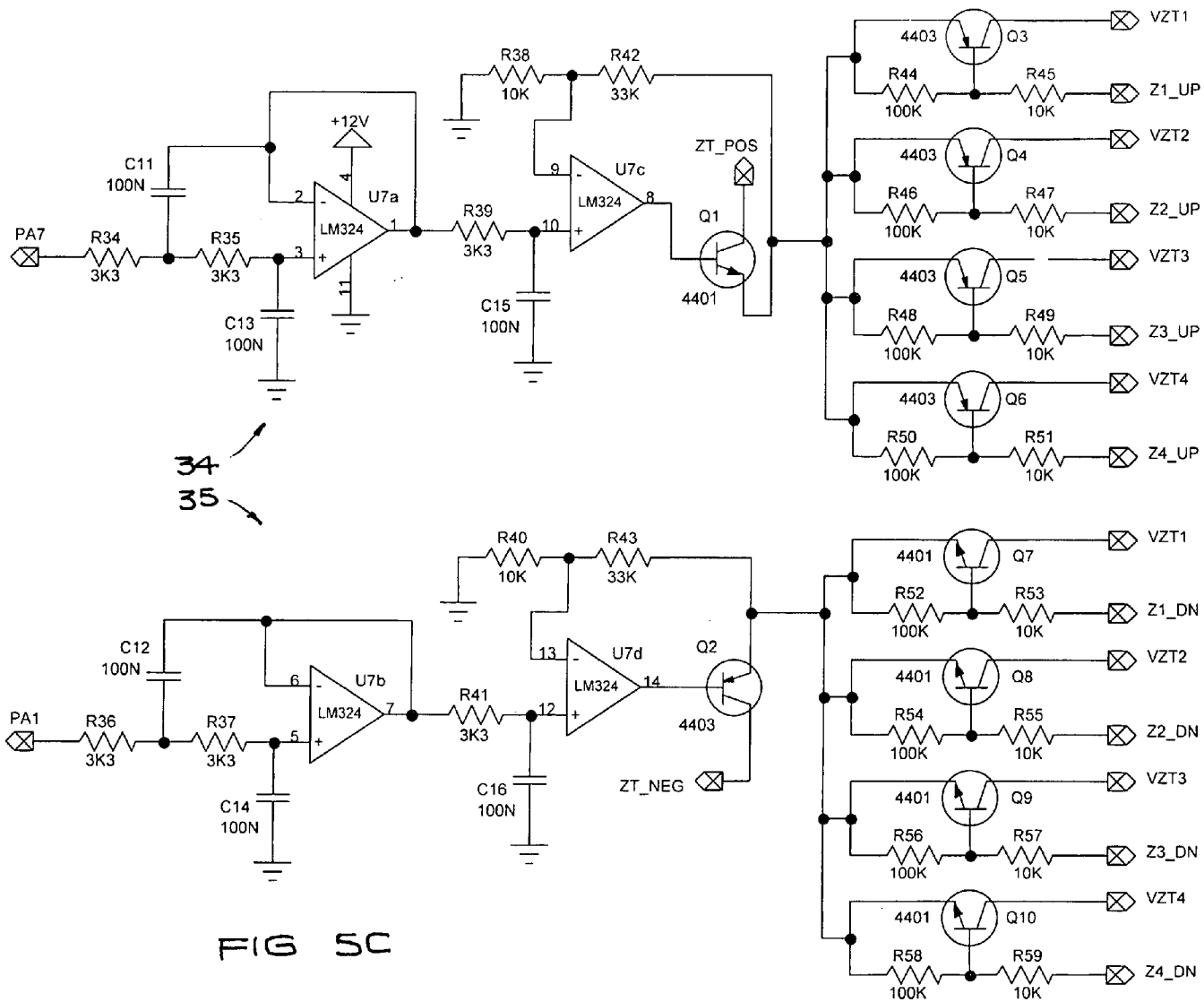
Figure 5D:
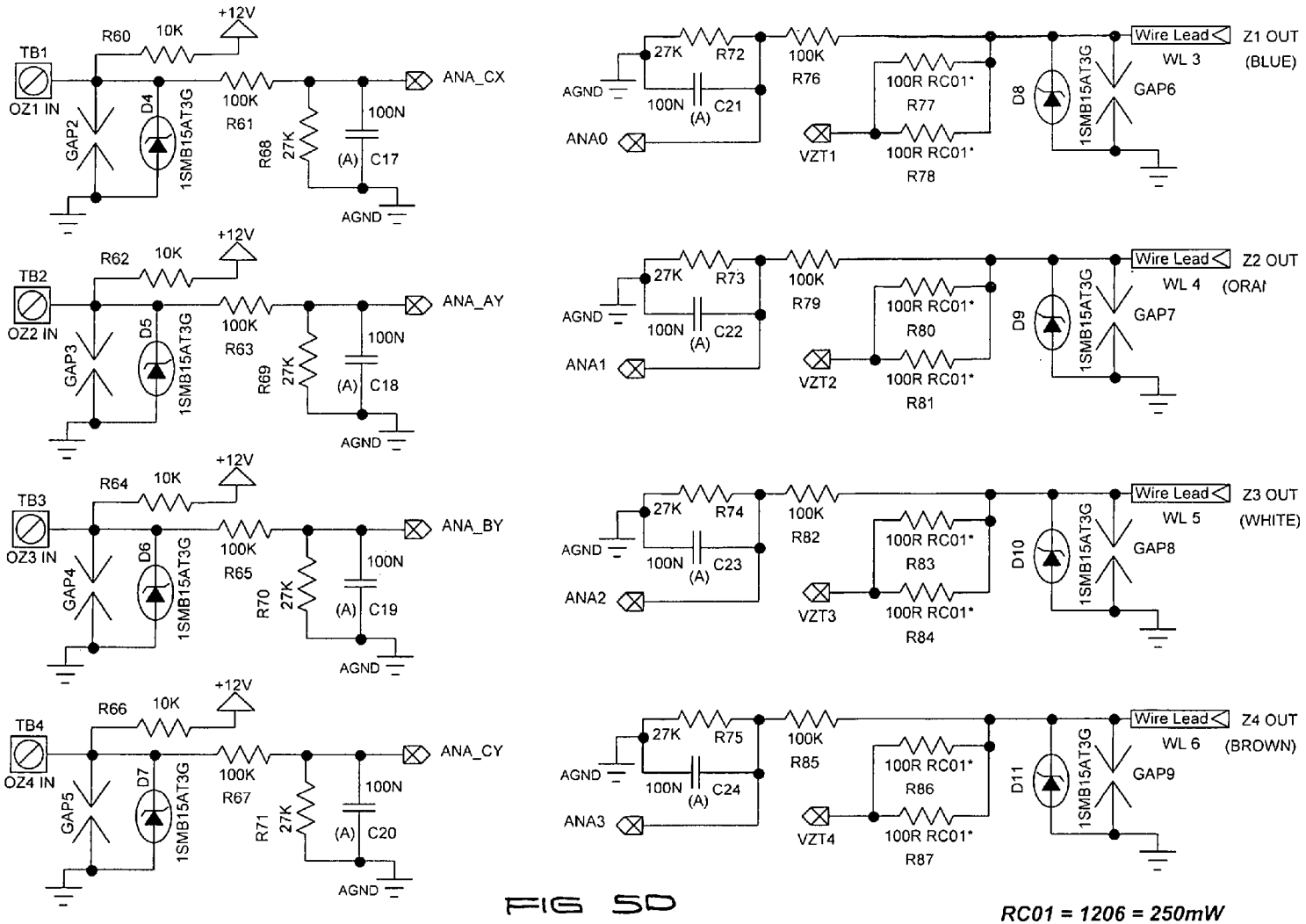
Figure 5E:
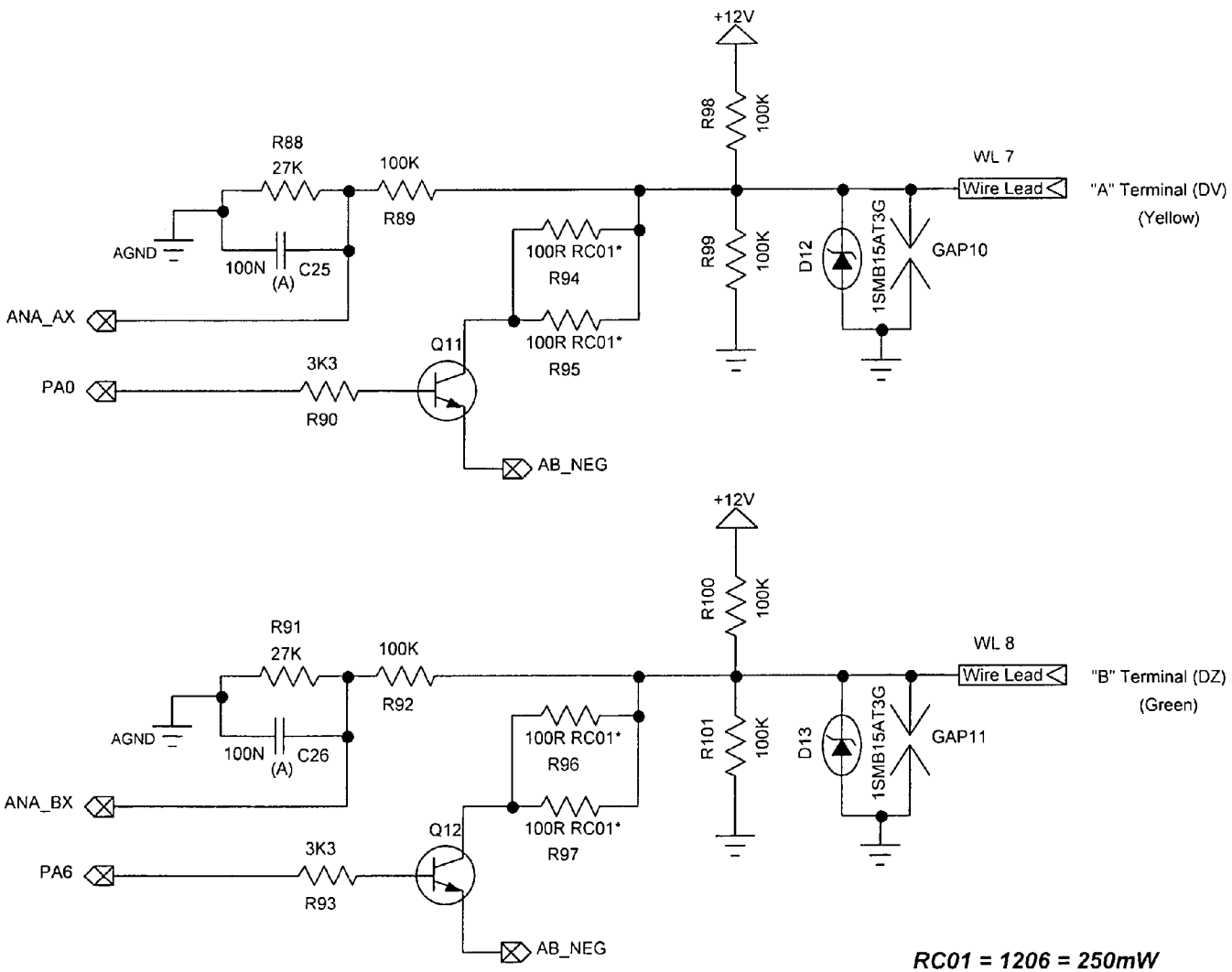

Although it is rare, when a closed zone loop is detected, the FAR system will be installed by electrically connecting the FAR system in series with the zone detector 10" in the closed zone loop as shown in FIG. 4B.

The zone detectors 10, 10', 10" are embodied as normally closed motion sensors. However, normally opened zone detectors can also be used. For normally opened zone detectors, the EOL zone loop has a restore state loop voltage of full voltage (12V), and an alarm state loop voltage of half voltage (6V), and that the DEOL zone loop has a restore state loop voltage of ¾ voltage (9V), an alarm state loop voltage of half voltage (6V) and a case tamper loop voltage of full voltage (12V), and that the closed zone loop has a restore state loop voltage of full voltage (12V) and an alarm state loop voltage of 0V.

For all kinds of zone detector, the control panel 20 has a general acceptable tolerance of more or less 20% for the loop voltage. For the EOL zone loop as shown in FIGS. 2A-2B, for example, the control panel 20 may recognize a restore state loop voltage from 4.8V to 7.2V and an alarm state loop voltage from 9.6V to 14.4V. For the DEOL zone loop as shown in FIGS. 3A-3B, for example, the control panel 20 may recognize a restore state loop voltage from 4.8V to 7.2V, an alarm state loop voltage from 7.2V to 9.6V or 10.8V, and a case tamper loop voltage from 9.6V or 10.8 V to 14.4V. For the closed zone loop as shown in FIGS. 4A-4B, for example, the control panel 20 may recognize an alarm state loop voltage from 9.6V to 14.4V.

In other words, for example, the control panel 20 will not respond even though a 7V loop voltage is presented in the control panel 20. The FAR system 30 comprises circuitry capable of generating a wide range of voltages and presenting them individually on each connected T-Tap zone 40, as shown in FIG. 1. The FAR system 30 includes means for monitoring the voltage on the connected T-Tap zone 40 to determine whether each of the zone detectors 10 is in the restore state or the alarm state of the zone loop since the zone loop is typically connected to the zone detector so in essence the state of the zone detector is being monitored. Other states of the zone loop such as a fault and trouble can also be optionally monitored.

The FAR system 30 also includes means for simultaneously and independently asserting either a desired alarm state or a desired restore state to the control panel 20 by generating and injecting an altered voltage which is within the predetermined tolerance window of the control panel 20 to present the desired alarm or restore state to the control panel 20. The altered voltages when presented to the control panel (alarm control panel or zone expander) 20 can overdrive the natural or previously present voltage of the zone loop. This allows the FAR system to present an alarm or restore state to the control panel 20 regardless of the true condition of the connected T-Tap zone 40, i.e. zone detector output.

The FAR system 30 includes a Pull-Up voltage circuit 34 for altering the loop voltage to a higher voltage and a Pull-Down voltage circuit 35

The false alarm reduction (FAR) method of the FAR system comprises the following steps:

(a) Generate and inject an altered voltage which is within a predetermined tolerance window of the control panel 20 to selectively present a desired restore state or a desired alarm state to the control panel to overdrive a natural or previously present loop voltage of the zone loop of the respective zone detector 10 with respect to the control panel 20, i.e. the actual loop voltage measured in the zone loop.

(b) Simultaneously monitor any change of the loop voltage of the monitoring zones between a restore state loop voltage and an alarm state loop voltage for each of the zone detectors 10 with respect to the control panel 20.

The false alarm reduction method further comprises the following steps:

(c) Present the desired restore state to the control panel 20 within a response time for the control panel by injecting the altered voltage to the control panel 20 for a predetermined period of time when the loop voltage of one of the zone detectors 10 within the respective monitoring zone is monitored as the alarm state loop voltage, i.e. changing from the restore state loop voltage to the alarm state loop voltage.

(d1) Thereafter, when the loop voltage of one of the other zone detectors 10 in different monitoring zone is also monitored as the alarm state loop voltage within the predetermined period of time, present the desired alarm state to the control panel 20 for corresponding alarm response such as activating a local warning system to produce warning signals and/or activating a communication system such as an internet or a phone dialing system to transmit digital signals to a central station 8 for dispatching to a designated police resource.

(d2) Alternatively, when the loop voltage of another two of the other zone detectors 10 in different monitoring zones are also monitored as the alarm state loop voltage within a predetermined period of time, present the desired alarm state to the control panel 20 for corresponding alarm response such as activating a local warning system to produce warning signals and/or activating a communication system such as an internet or a phone dialing system to transmit digital signals to a central station 38 for dispatching to a designated police resource.

(d3) Or, when one or more zone detectors 10 within the respective monitoring zone are also monitored as the alarm state loop voltage within the predetermined period of time, present the desired alarm state to the control panel 20 for corresponding alarm response such as activating a local warning system to produce warning signals and/or activating a communication system such as an internet or a phone dialing system to transmit digital signals to a central station 38 for dispatching to a designated police resource.

In the step (a), the injected altered voltage is configured as either sink current to the desired set point or source current to the desired set point. Each connected T-Tap zone 40 actually has two software controlled voltage sources, i.e. the Pull-UP voltage circuit 34 and the Pull-Down voltage circuit 35. According to the preferred embodiment of the present invention, the Pull-Up voltage circuit 34 raises the loop voltage above the natural or previously present loop voltage to a desired set point but will not lower it below the natural or previously present loop voltage; conversely the Pull-Down voltage circuit 35 lowers the loop voltage below the natural or previously present loop voltage to a desired set point but will not raise the natural or previously present loop voltage.

As described above, the FAR system 30 is capable of both determining the alarm/restore state of the monitoring zone (i.e. zone detector) while simultaneously presenting independently different alarm or restore states to the control panel 20. In other words, the FAR system 30 basically reads the state of the zone detectors 10 while independently asserting either a desired alarm state or a desired restore state to the control panel 20. This is done even though a physical connection exists between the zone detectors 10 and the zone inputs 21 on the control panel 20. This is accomplished by the step (a) described above, wherein the altered voltage is sufficiently altered from the natural or previously present loop voltage in order to make an accurate measurement between the altered voltage and the natural or previously present loop voltage.

The altered voltage may be above or below the natural or previously present loop voltage and is dependant on the type of zone supervision used and the state that is being manufactured.

The step (a) of the FAR method further comprises a step of selecting either the Pull-Up voltage circuit 34 or the Pull-Down voltage circuit 35 for the desired outcome. For example, in the step (c), the loop voltage of a first zone detector 10 within a first monitoring zone is full voltage 12V, i.e. a motion is detected in the monitoring zone by the zone detector 10 thereof, the Pull-Down voltage circuit is selected to alter the loop voltage to a lower value below 7.2V, for example 6.6V, within the predetermined tolerance window (±20%) of the control panel 20, wherein the 6.6V becomes the alarm state loop voltage for the first zone detector during the predetermined period of time and forms the altered voltage to be injected to present as the desired restore state to the control panel 20 for the predetermined period of time during which no alarm respond will be performed.

During the predetermined period of time, although the altered voltage 6.6V as the desired restore state is injected to present to the control panel 20 for all zone detectors 10 of all monitoring zones, the zone state of the all the monitoring zones, including the first monitoring zone and the first zone detector 10, are still continuously monitored by the FAR system, wherein when no motion is detected by the first zone detector 10 in the first monitoring zone and other zone detectors 10, its loop voltage is half voltage (6V) forming the restore state loop voltage of the respective monitoring zone. While a motion is detected by the first zone detector 10 or any other zone detector 10, although the loop voltage is pulled down to 6.6V as the altered voltage injected to the control panel 20, the fine resolution of the FAR system can still monitor the voltage change from the 6V restore state to a 6.6V alarm state. The 6.6V loop voltage also forms the alarm state loop voltage with respect to the 6V restore state loop voltage for the respective monitoring zone. In other words, the FAR system is still self sensing the alarm/restore zone state of all the zone detectors 10 and monitoring zones. The FAR system may respond accordingly to present desired alarm state to the control panel 20 according to the preset logic.

Therefore, in the step (d1), for example, if the FAR system monitors the loop voltage of a second zone detector 10 in a second monitoring zone changes from the 6V restore state loop voltage to the 6.6V alarm state loop voltage within the predetermined period of time, it means that another motion is detected by the second zone detector 10 in the second monitoring zone. Then, the natural full voltage 12V of the loop voltage of the second zone detector 10 becomes dominate and is presented to the control panel 20 as desired alarm state for corresponding alarm respond.

When the second monitoring zone is presented as desired alarm state for alarm respond, we want the initially triggered first monitoring zone be presented to the control panel 20 as alarm state too so that alarm respond, such as producing local warning signal, can be performed for the first monitoring zone. Therefore, the Pull-Up voltage circuit 35 is now selected for the zone loop of the first zone detector 10 to alter the loop voltage to a higher value more than 9.6V within the tolerance window of full voltage 12V of the desired alarm state, e.g. 10V, so that a desired alarm state loop voltage is presented to the control panel 20 for alarm respond for the first monitoring zone. Moreover, if a second motion is detected by the first zone detector 10 or another zone detector within the first monitoring zone, the loop voltage of the first monitoring zone is monitored as the alarm state loop voltage, 12V, the full voltage (12V) of the alarm state loop voltage will become dominate and be presented as desired alarm state to the control panel 20 for alarm respond for the first monitoring zone.

Since the voltage circuits 34, 35 only operate in one direction, i.e. sink or source, the altered voltage will be present only as long as the state of the zone detector 10 is different from the desired state presented to the control panel 20. When the zone state of the zone detector 10 and the desired state presented to the control panel 20 is the same, the natural or previously present loop voltage becomes dominate. The ability to measure the difference between the altered voltage and the natural or previously present voltage provides the FAR system with the means for determining if the zone state and the desired state presented to the control panel 20 are in conflict or if they match. This therefore allows the FAR system to simultaneously monitor the true state of the monitoring zone (i.e. the zone detector) while presenting any desired state to present to the control panel 20.

The typical debounce or response time for an alarm control panel 20 is between 400 mS and 750 mS. The FAR system operates by responding to zone state changes much faster (typically 50 mS) while still respecting the typical response time (400 mS to 750 mS). The FAR system is continuously monitoring the connected T-Tap zones 40 as well as any Optional Zone Inputs. When a preliminary state change of approximately 50 mS is detected, the FAR system asserts the original zone state using the methods described above. Theatrically speaking, this "fools" the control panel 20 into thinking that the monitoring zone has not changed zone state because the typical response time of 400 mS to 750 mS has not been met. Meanwhile the FAR system continues to monitor the same monitoring zone using the shelf sensing to see if it truly qualifies as a zone state change by meeting the typical response time (400 ms to 750 mS). If it does, then the FAR system proceeds with the DVC logic. If it does not, the monitoring zone assertion at the control panel 20 is removed.

Figure 6:
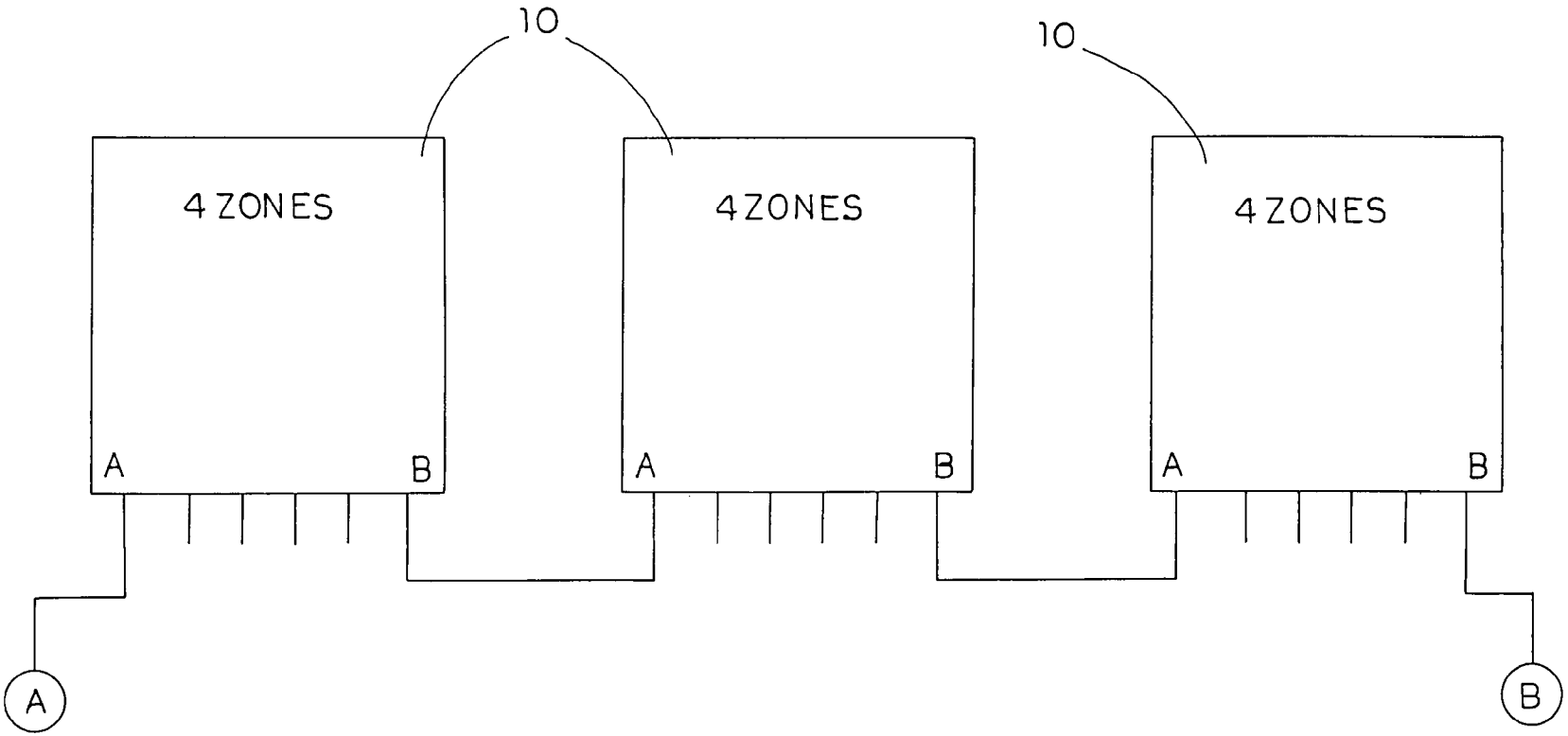
FIG. 6 is a schematic diagram to illustrate three FAR systems are linked to form a virtual unit to support twelve monitoring zones according to the above preferred embodiment of the present invention.
Figure 7:
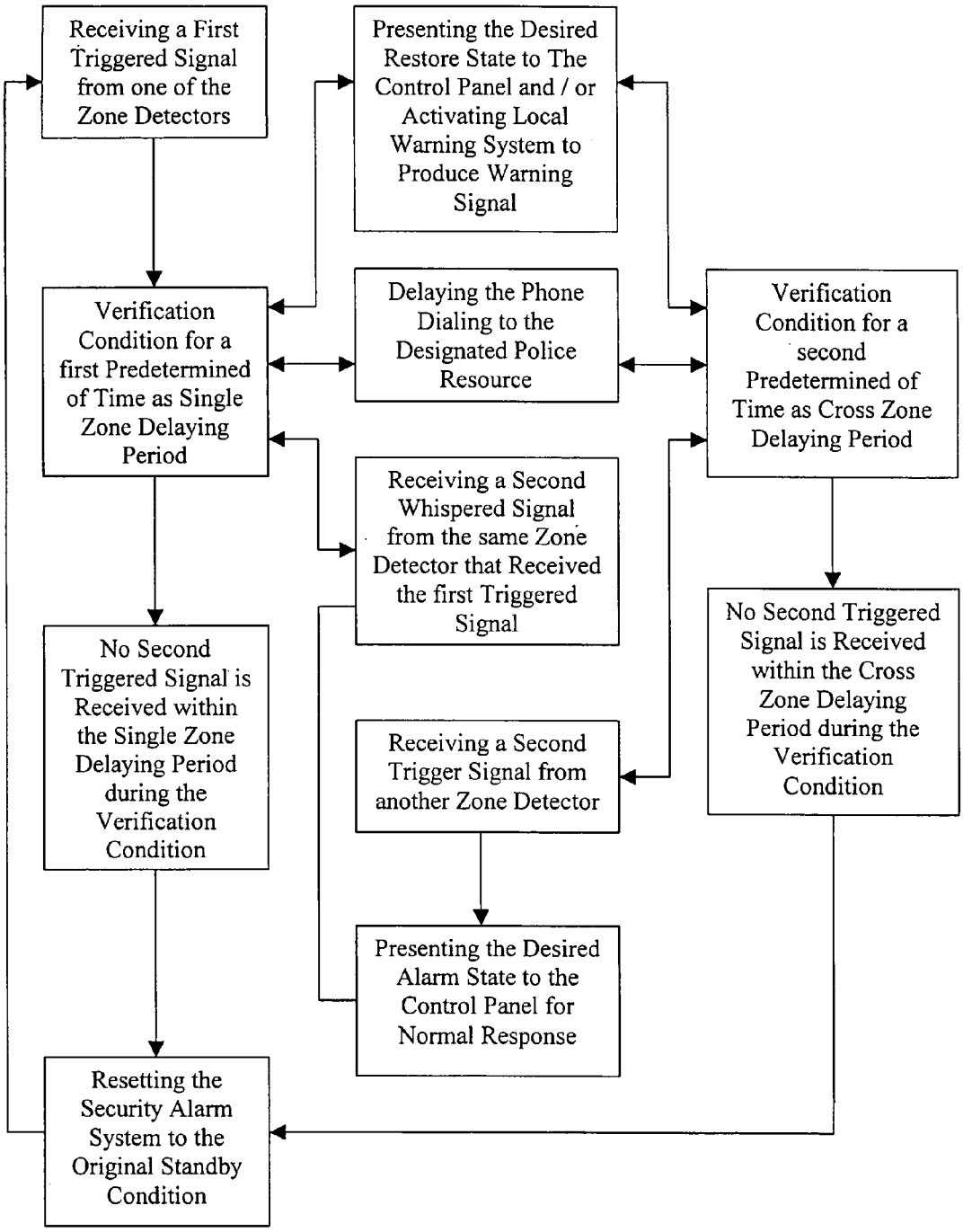
FIG. 7 is a block diagram illustrating the digital verification control according to the above preferred embodiment of the present invention.

The FAR system which is embodied to support four monitoring zones automatically determines which monitoring zones are used and which are not. The unused monitoring zones are excluded from the DVC logic. This is accomplished by measuring the voltage present on the connected T-Tap monitoring zones 40 while momentarily injecting a test voltage and measuring the result. If the wire is not connected the monitoring zone is ruled as not active. It is worth to mention that the FAR system can be made to support more or less than four monitoring zones. However, as shown in FIG. 6, when more than four monitoring zones are presented, for example three four-zone FAR systems can be connected in series to form a virtual unit to support 12 monitoring zones.

The A and B terminals of the FAR system take on different functionality dependent on local conditions. For example, if neither terminal is connected directly to ground or positive supply or each other, then the terminals become outputs (i.e. DV and DZ). If the A terminal is grounded, then B terminal becomes a negative triggered input (i.e. control panel status active low). If the A terminal is connected to positive supply, then the B terminal becomes a positive triggered input (i.e. control panel status active high). Conversely the same applies for grounding or tying to positive the B terminal. The A terminal can have two different output operations. If the A and B terminals are connected together, they tell the DVC logic to modify its behavior (i.e. triple knock) while still providing a single output function, i.e. DV.

If the panel armed status input is used on the A and B terminals, then this tells the DVC logic to potentially modify its behavior for a period of time following the arming of the alarm system. This for example might invoke triple knock instead of double knock for a post arming period of 45 minutes.

Furthermore, the FAR system provides an over current and short circuit protection on all external connections. This is accomplished with fast acting hardware based circuitry that immediately turns off the zone T-Tap of A/B output in the event of a short circuit. For lesser but still illegal over current conditions the software which is continuously monitoring all outputs and inputs can take the appropriate action to resolve the problem.

The FAR system can also continuously monitor for and diagnoses installation, wiring, component, or power supply problems. Following installation, the FAR system will generate a trouble condition (flashing LED) if it has been incorrectly installed. Typical errors would be failure to use the optional zone inputs for normally closed zone loops or using different zone supervision modes across the 4 zones. Wiring errors that cause shorts or over current as well as abnormal power supply voltages may also be reported. Some internal circuitry failure is also reported. The FAR system is generally failsafe. It will either allow the monitoring zones to pass through unaltered or present them as an alarm condition.

The FAR system is capable of measuring any interference signals (typically AC induction) that is being presented to the alarm control panel 20 and generating voltages and injecting them into the control panel 20. With both of these capabilities the FAR system is able to monitor and analyse an interference signal and then generate an inverse signal that when injected will cancel out the original interference signal, in order to dramatically reduce false alarms while improving reliability of the overall security alarm system.

In addition, a 10 bit ADC measures the voltage present on the zone T-Taps. The FAR logic processes this and may present a 10 bit PWM output that is converted to a voltage that may be presented to the same zone T-Taps. This is a special case of a modified feedback loop.

The false alarm reduction (FAR) method and system is further incorporated with a digital verification control according to the above preferred embodiment. Also, the security alarm system generally further comprises a local warning system 36 electrically connected to the alarm control panel 20 and a communication system 37 such as an internet and/or dialing system being built in the alarm control panel 20 for transmitting signals to a central station 38 for dispatching to a designated police resource when the communication system 20 is activated, as shown in FIG. 1.

The digital verification control comprises a first means for presetting a single zone verification time in the FAR system and a second mean for presetting a multiple zone verification time in the FAR system. Accordingly, the first and second means are timer devices, which can be built-in with the FAR system, for generating and injecting the altered voltage to present the desired restore state to the control panel 20 with the response time for the predetermined period of time when the zone detector 10 within the respective monitoring zone is monitored as the alarm state loop voltage, i.e. a motion is firstly detected by the zone detector 10, as stated in the above step (c).

The digital verification control is mainly to configure a time frame for the FAR system to optimize both the false alarm reduction performance and the security protection performance, wherein a process of the digital verification control comprises the following steps.

(1) Preset the single zone verification time as the predetermined period of time in the step (c), i.e. a single detector time delay for each of the zone detectors 10 in such a manner that when one of the zone detectors 10 detects at least two triggered signals in the respective monitoring zone within the single zone verification time, the loop voltage of the respective zone detector 10 within the respective monitoring zone is monitored as the alarm state loop voltage, i.e. changing from the restore state loop voltage to the alarm state loop voltage.

(2) Preset the multiple zone verification time as a multiple detector time delay for the zone detectors 10 wherein the multiple zone verification time must be longer than the single zone verification time in such a manner that when two or more of the zone detectors 10 detect two or more motions in the monitoring zones respectively within the multiple zone verification time, the loop voltage of the zone detectors 10 within the monitoring zones are monitored as the alarm state loop voltage, i.e. changing from the restore state loop voltage to the alarm state loop voltage.

Accordingly, the single zone verification time and the multiple zone verification time are preset in the FAR system to configure the time frame of each of the zone detectors 10.

The false alarm reduction method of the security alarm system, which is activated by the alarm user by keying in the security code into an activating and de-activating keypad, further comprises the steps as follows.

A. Present the desired restore state to the control panel 20 within the response time for the control panel 20 by injecting the altered voltage to the control panel 20 (and optionally activate the local warning system 36 to produce a local warning signal) for a designated period of time, normally two to five minutes, when any one of the zone detectors 10 detects a triggered signal within the respective monitoring during a standby condition of the FAR system.

B. Delay to activate the control panel 20 as well as the communication system 37 for a first preset time period as the single zone verification time and at least a second preset time period as the multiple zone verification time which is longer than the single zone verification time, wherein the security alarm system is in a verification condition during the single zone and multiple zone verification times.

C. Present the desired alarm state to said control panel 20 to activate the control panel 20 to normally respond by activating the local warning system 36 to produce warning signals and the communication system 37 to transmit digital signals to the central station 38 when the same zone detector 10 that detected the first triggered signal detects another triggered signal in the same monitoring zone within the single zone verification time during the verification condition.

D. Present the desired alarm state to said control panel 20 to activate the control panel 20 to normally respond by activating the local warning system 36 to produce warning signals and the communication system 37 to transmit digital signals to the central station 38 when another zone detector 10 detects another triggered signal in another monitoring zone within the multiple zone verification time during the verification condition.

E. Reset the security alarm system to the original standby condition when there is no other triggered signal is detected by any zone detectors 10 during the verification condition, wherein the standby alarm system is ready to enter the verification condition again when there is signal detected by any of the zone detectors 10 again.

Accordingly, each of the sensors of the alarm system, such as the PIR sensors and the motion sensors, is installed to provide the monitoring zone, i.e. a motion detecting area, in such a manner that when one of the sensors detect a triggered motion as the signal, the alarm system is activated in the verification condition. It is worth to mention that other kinds of sensor can be used in the alarm system, such as shock sensors, GBD and contacts, and door/window sensors. In addition, different types of sensors can be used in the alarm system. For example, the door sensor is installed at the door entrance for detecting the signal of the door in an opened and closed manner while the motion sensor is installed at the living room for detecting the motion signal within the motion detecting area, wherein both the door sensor and the motion sensor are electrically connected to the control panel.

According to the preferred embodiment, the process of reducing the false alarm for the alarm system is incorporated with a verification control process to optimize the false alarm reduction performance and the security protection performance. The sensitivities of the single zone verification time and the multiple zone verification time with respect to the false alarm possibility and security protection for the alarm system are determined by a single zone verification analysis and a multiple zone verification analysis respectively.

Figure 10:
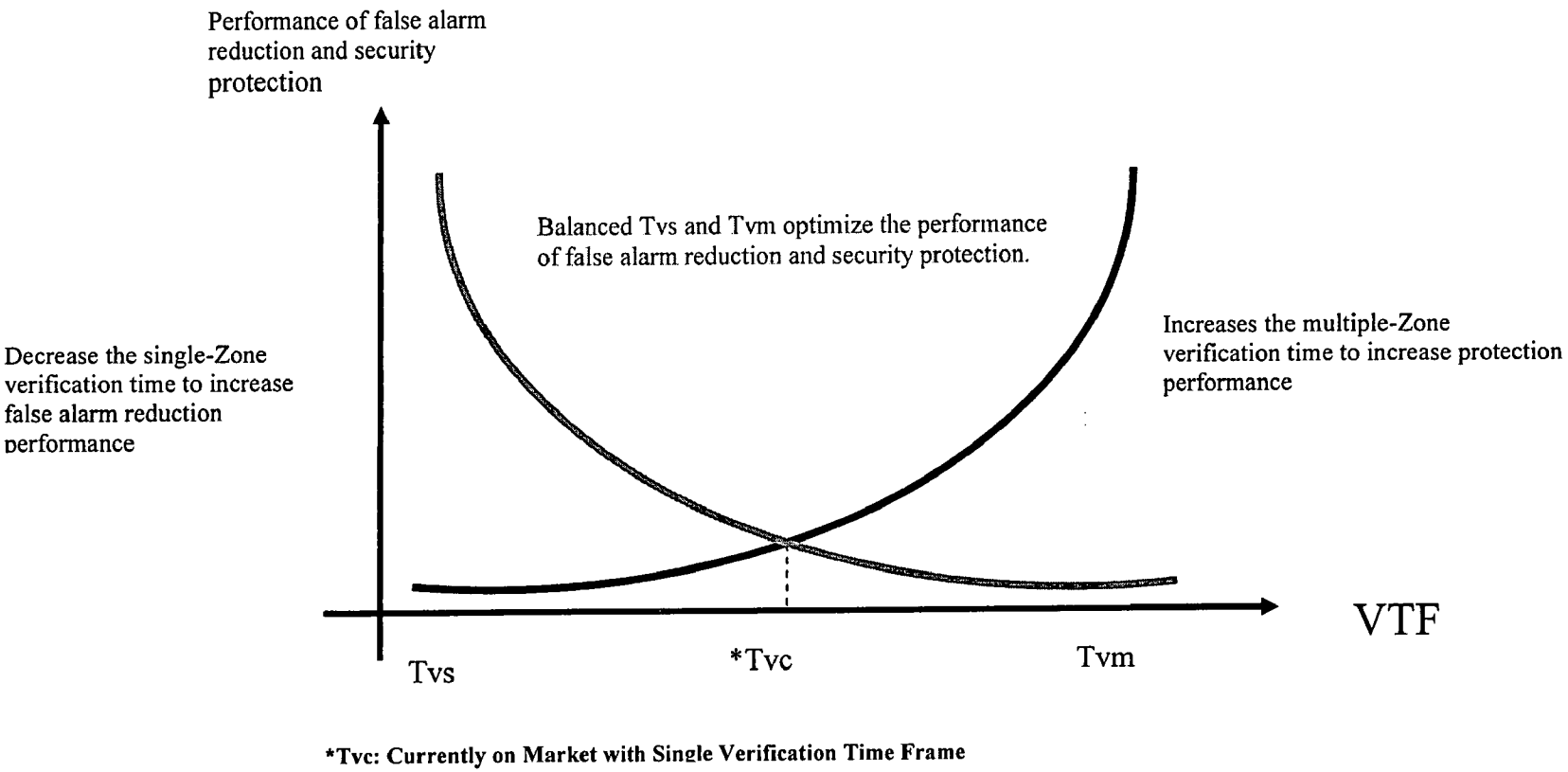
FIG. 10 is a graph of the digital verification control process for the FAR system according to the above preferred embodiment of the present invention, illustrating the combination of the single zone verification analysis and the multiple zone verification analysis.

As shown in FIG. 10, the single zone verification analysis is performed for analyzing a relationship between the single zone verification time and a performance of false alarm reduction and security protection, wherein a single zone verification curve is formed to indicate that when the single zone verification time is increased, the performance of false alarm reduction and security protection reduced. In other words, while decreasing the single zone verification time, the false alarm reduction performance will be increased.

In addition, the multiple zone verification analysis is performed for analyzing a relationship between the multiple zone verification time and the performance of false alarm reduction and security protection, wherein a multiple zone verification curve is formed to indicate that when a multiple zone verification time is increased, the performance of false alarm reduction and security protection increased.

As it is mentioned in the background, the single zone verification time, which is the same as the multiple zone verification time, for the conventional alarm system is determined by combining the single zone verification analysis and the multiple zone verification analysis, wherein the conventional verification time is preset at an intersection of the single zone verification curve and the multiple zone verification curve.

Figure 8:
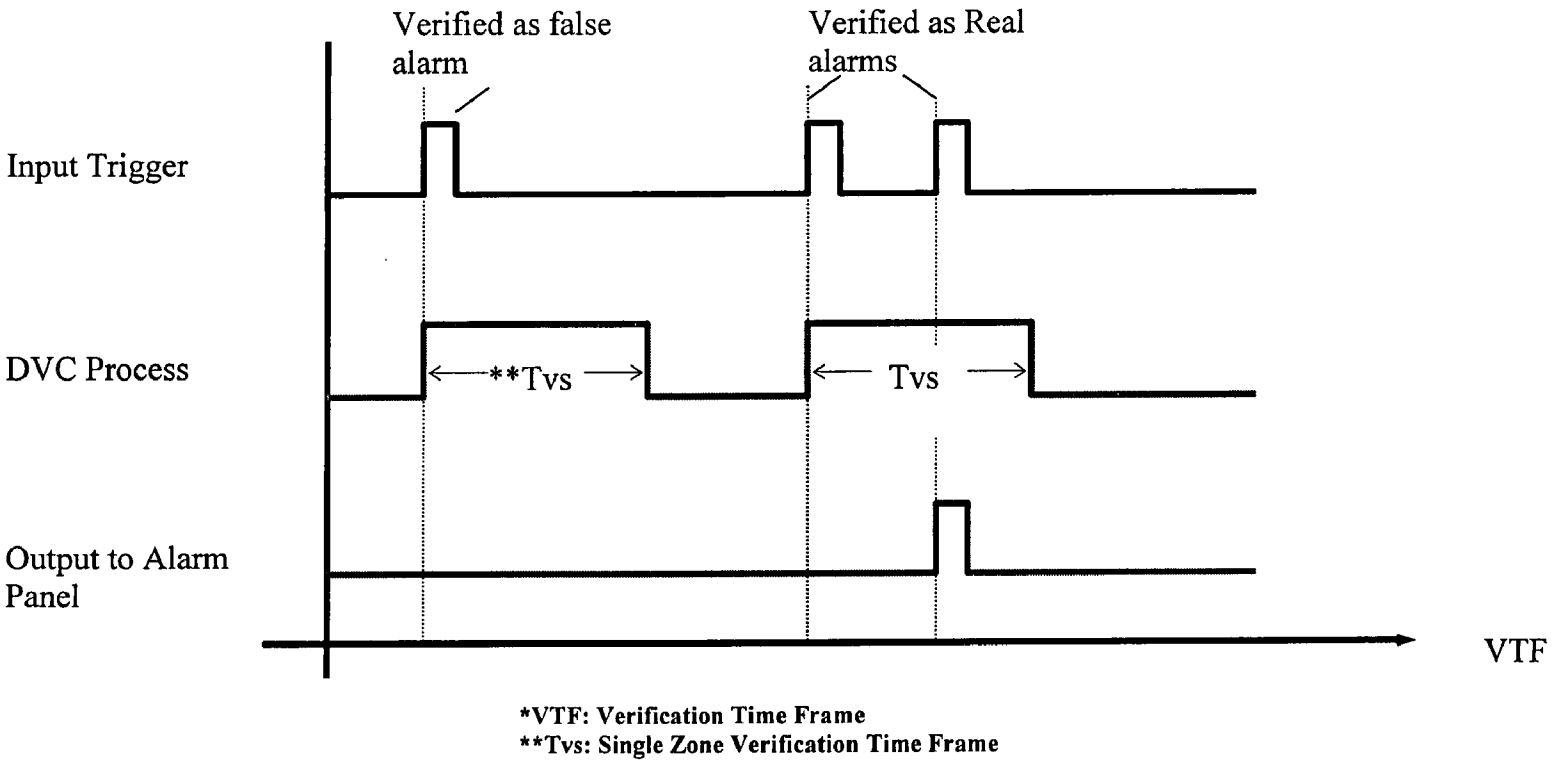
FIG. 8 is a graph of a single zone verification analysis of the digital verification control process for the FAR system according to the above preferred embodiment of the present invention.

According to the preferred embodiment, the single zone verification analysis is performed to verify the single zone verification time so as to reduce the false alarm possibility of the alarm system. As shown in FIG. 8, when the triggered signal is first received by one of the zone detectors 10 within the monitoring zone, the single zone verification is started while the security alarm system is in the verification condition. If there is no other triggered signal is detected by the same zone detector 10 within the single zone verification time, the security alarm system is reset back to the standby condition so that no local warming signal and no digital signal is transmitted to the central station 38. In other words, the first trigger is verified as a false alarm.

When another triggered signal is detected by the same sensor within the single verification time, the local warning system 36 is activated to produce warning signals and the communication system 37 is activated to transmit digital signals to the central station 38.

The single zone verification analysis mainly verifies the single verification time with respect to the false alarm possibility. When the single zone verification time is lengthened to reduce the false alarm possibility, the security protection of the security alarm system will be decreased. Therefore, by varying the single zone verification time, the single zone verification curve is plotted to indicate the relationship between the single zone verification time and the performance of false alarm reduction and security protection, as shown in FIG. 10.

After finishing the single zone verification analysis, the multiple zone verification analysis should be performed to verify the multiple zone verification time so as to reduce the false alarm possibility of the security alarm system.

The optimum single zone verification time, which is based on the single zone verification analysis, is determined by taking derivative with respect to time. As shown in FIG. 10, the single zone verification time should preset at a range from 5 to 15 seconds to obtain optimum the false alarm reduction performance. Accordingly, the optimum single zone verification time is preferred to be preset at 10 seconds.

The optimum multiple zone verification time, which must be longer than the single zone verification time, is determined based on the multiple zone verification analysis by taking derivative with respect to time. As shown in FIG. 10, the multiple zone verification time is preset less than 1-3 minutes to obtain the optimum security protection performance. Accordingly, the optimum multiple zone verification time is preferred to be preset at 2 minutes.

Figure 9:
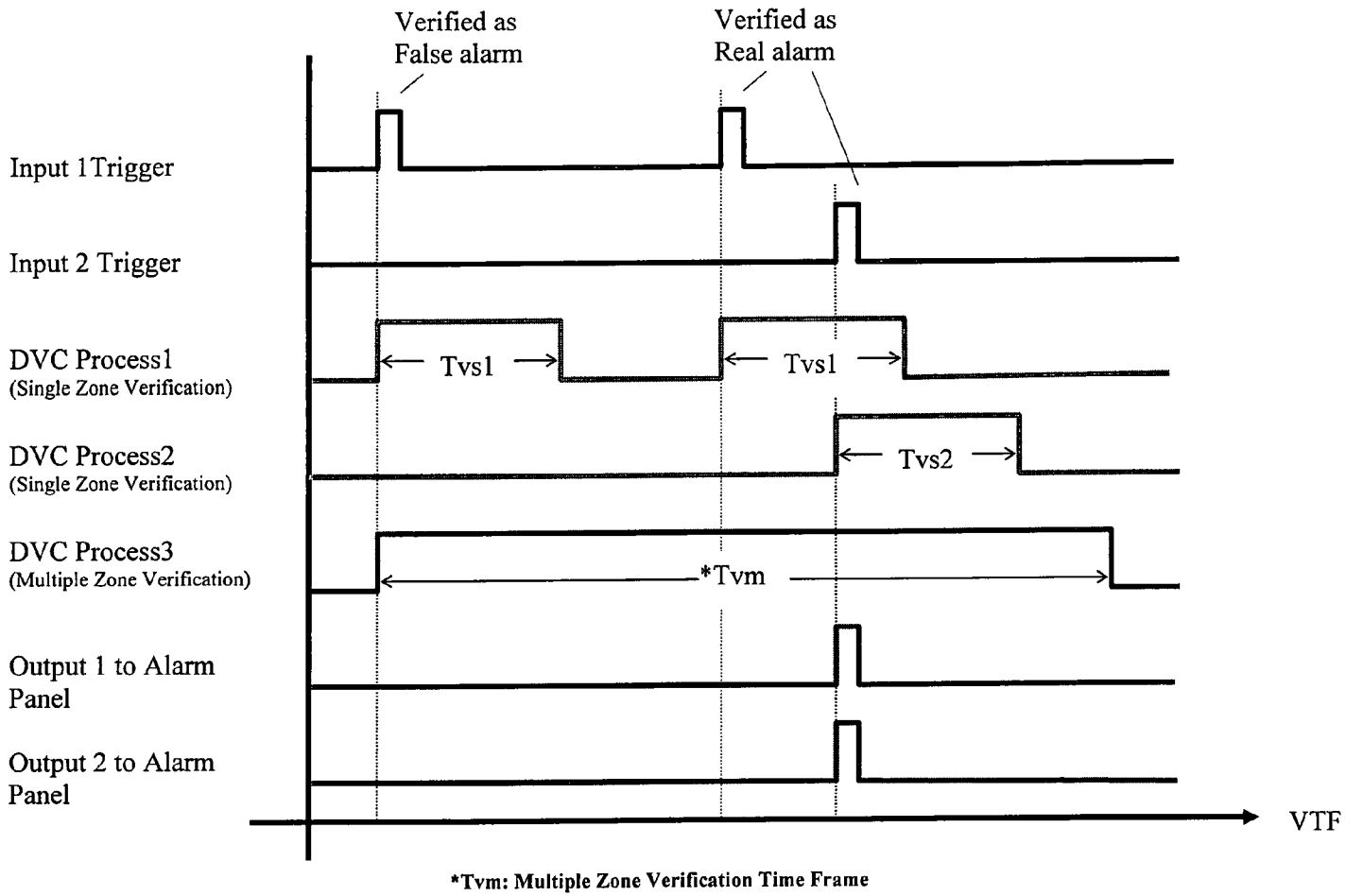
FIG. 9 is a graph of a multiple zone verification analysis of the digital verification control process for the FAR system according to the above preferred embodiment of the present invention.

As shown in FIG. 9, when the triggered signal is first received by one of the zone detectors 10 within the monitoring zone, both the single zone verification and the multiple zone verification are started at the same time while the security alarm system is in the verification condition. If there is no second triggered signal is detected either by the same zone detector 10 within the single zone verification time or by another zone detector 10 within the multiple zone verification time, the security alarm system is reset back to the standby condition, so that no local warming signal and no digital signal is transmitted to the central station 38. Therefore, there is a false alarm.

When another zone detector 10 detects the second triggered signal within the respective monitoring zone within the multiple zone verification area, the local warning system 36 is activated to produce warning signals and/or the communication system 37 is activated to transmit digital signals to the central station 38. It is worth to mention that when the second zone detector 10 detects the second triggered signal, the single zone verification time of the second zone detector 10 will be simultaneously started. Therefore, the multiple zone verification time must be set longer than the single zone verification time.

The multiple zone verification analysis mainly verifies the multiple verification time with respect to the false alarm possibility. When the multiple zone verification time is lengthened to reduce the false alarm possibility, the security protection of the security alarm system will be increased. Therefore, by varying the multiple zone verification time, the multiple zone verification curve is plotted to indicate the relationship between the multiple zone verification time and the performance of false alarm reduction and security protection, as shown in FIG. 10.

As a result, the single zone verification curve and the multiple zone verification curve are formed after performing the single zone verification analysis and the multiple zone verification analysis respectively. Since both the single zone verification curve and the multiple zone verification curve are related to the performance of false alarm reduction and security protection with respect to the time frame. Therefore, the results of the single zone verification analysis and the multiple zone verification analysis can be combined to overlap the single zone verification curve and the multiple zone verification curve in accordance with the performance of false alarm reduction and security protection and the time frame, as shown in FIG. 10. It is worth to mention that the results of the single zone verification analysis and the multiple zone verification analysis are sent to the central station 38 such that the experienced alarm consultant at the central station 38 is able to analysis the optimum verification times, i.e. the optimum single zone verification time and the optimum multiple zone verification time, so as to minimize any computerized error during calculation.

It is worth to mention that since the single zone verification time is determined by the single zone verification curve through the single zone verification analysis and the multiple zone verification time is determined by the multiple zone verification curve through the multiple zone verification analysis, the single zone verification time and the multiple zone verification time are capable of presetting at any conventional alarm system as a time configuration thereof to maximize the performance of false alarm reduction and security protection of the security alarm system.

Accordingly, the verification control process is effective in all types of false alarms:

| Type of False Alarm | Percent | False Alarm Reduction Rate |
|---|---|---|
| Generated Fortuitously | 30% | 100% |
| Generated with Certain Patterns | 60% | 98% |
| Bad Environment, e.g. outdoor applications | 10% | 95% |

Before activating the local warning system 36 to produce warning signals and communication system 37 to transmit digital signal to the central station 38, the security alarm system may further comprise a video system 39 connected to a digital video output of the control panel. Therefore, the process for reducing false of the alarm system further comprises the steps as follows.

(1) Activate the digital cameras or video cameras of the video system 39 to record and transmit the real-time scene to the central station 38 for a designated period of time for monitoring and verifying whether there is any burglar within the detecting areas.

(2) Activate the control panel to normally respond by activating the local warning system to produce warning signals and the dialing system to transmit digital signals to the central station 38 to call police when a burglar is found in the detecting areas via the video system.

(3) Reset the alarm system to the original standby condition when there is no burglar found in the detecting areas via the video system.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A false alarm reduction method for a security alarm system comprising a control panel having a predetermined tolerance window of impedance change and one or more zone detectors installed at one or more monitoring zones and electrically connected to said control panel in such a manner that when one of said zone detectors detects a triggered signal, a loop impedance of said zone detector and said control panel changes from a restore state impedance to an alarm state impedance which is different to said restore state impedance for a predetermined value, wherein said false alarm reduction method comprises the steps of:

(a) generating and injecting an altered impedance which is within said predetermined tolerance window of said control panel to present a desired state to said control panel; and (b) monitoring any change of said loop impedance between said restore state impedance and said alarm state impedance for each of said zone detectors with respect to said control panel.

2. The false alarm reduction method, as recited in claim 1, after the step (b), further comprising the step of:

(c) presenting a desired restore state to said control panel when said loop impedances of said zone detectors within said monitoring zones are each monitored as said restore state impedance; and (d) presenting said desired restore state to said control panel when said loop impedance of one of said zone detectors within said respective monitoring zone is monitored as said alarm state impedance.

3. The false alarm reduction method, as recited in claim 2, after the step (d), further comprising a step of:

(e1) when said loop impedance of one of said other zone detectors is also monitored as said alarm state impedance within a predetermined period of time or at least one more zone detector within said respective monitoring zone is also monitored as said alarm state impedance within said predetermined period of time, presenting said desired alarm state to said control panel for alarm response.

4. The false alarm reduction method, as recited in claim 2, after the step (d), further comprising a step of:

(e2) when said loop voltage of another two of said other zone detectors in two of said monitoring zones are also monitored as said alarm state loop voltage within a predetermined period of time, presenting said desired alarm state to said control panel for alarm response.

5. The false alarm reduction method, as recited in claim 2, after the step (d), further comprising a step of:

(e3) when one or more zone detectors within said respective monitoring zone are also monitored as said alarm state loop voltage within a predetermined period of time, presenting said desired alarm state to said control panel for alarm response.

6. The false alarm reduction method, as recited in claim 2, after the step (d), further comprising the steps of:

(e1) when said loop impedance of one of said other zone detectors is also monitored as said alarm state impedance within a predetermined period of time or at least one more zone detector within said respective monitoring zone is also monitored as said alarm state impedance within said predetermined period of time, presenting said desired alarm state to said control panel for alarm response;

(e2) when said loop voltage of another two of said other zone detectors in two of said monitoring zones are also monitored as said alarm state loop voltage within said predetermined period of time, presenting said desired alarm state to said control panel for alarm response; and (e3) when one or more zone detectors within said respective monitoring zone are also monitored as said alarm state loop voltage within said predetermined period of time, presenting said desired alarm state to said control panel for alarm response.

7. The false alarm reduction method, as recited in claim 1, further comprising the steps of:

(c) presetting a single zone verification time as a predetermined period of time, that is a single detector time delay for each of said zone detectors in such a manner that when one of said zone detectors detects at least two triggered signals in said respective monitoring zone within said single zone verification time, said loop impedance of said respective zone detector within said respective monitoring zone is monitored as said alarm state loop impedance;

(d) presetting a multiple zone verification time as a multiple detector time delay for said zone detectors wherein said multiple zone verification time is longer than said single zone verification time in such a manner than when two or more of said zone detectors detect two or more triggered signals in said monitoring zones respectively within said multiple zone verification time, said loop impedance of said zone detectors within said monitoring zones are monitored as said alarm state loop impedance.

8. The false alarm reduction method, as recited in claim 7, further comprising a step of:

(e) when any one of said motion sensors detects a first triggered signal within said respective monitoring zone, presenting said desired restore state to said control panel within a response time for said control panel by injecting said altered impedance to said control panel for a designated period of time for delaying to activate said control panel and a communication system of said security alarm system for a first preset time period as said single zone verification time and at least a second preset time period as said multiple zone verification time which is longer than said single zone verification time, wherein said security alarm system is in a verification condition during said single zone and multiple zone verification times.

9. The false alarm reduction method, as recited in claim 8, further comprising a step of:

(f) when said zone detector that detected said triggered signal detects another triggered signal in said respective monitoring zone within said single zone verification time during said verification condition, presenting said desired alarm state to said control panel to activate said control panel for normal response.

10. The false alarm reduction method, as recited in claim 9, further comprising a step of:

(g) when another said zone detector detects another triggered signal in another said monitoring zone within said multiple zone verification time during said verification condition, present said desired alarm state to said control panel to activate said control panel for normal response.

11. The false alarm reduction method, as recited in claim 10, further comprising a step of:

(h) resetting said security alarm system to said original standby condition when there is no other triggered signal being detected by any of said zone detectors during said verification condition, wherein said security alarm system in said standby condition is ready to enter said verification condition again when there is any triggered signal detected by any of said zone detectors again.

12. The false alarm reduction method, as recited in claim 10, wherein the step (e) further comprises a substep of activating a local warning system to produce a local warning signal.

13. The false alarm reduction method, as recited in claim 10, wherein said normal response including activating a local warning system to produce warning signals and a communication system to transmit digital signals to a central station.

14. The false alarm reduction method, as recited in claim 12, wherein said normal response including activating said local warning system to produce warning signals and a communication system to transmit digital signals to a central station.

15. The false alarm reduction method, as recited in claim 1, further comprising a step of measuring any interference signals including any AC induction that is being presented to said control panel to monitor and analyse said interference signal and then generate an inverse signal that when injected cancels out said interference signal.

16. The false alarm reduction method, as recited in claim 6, wherein the step (a) further comprises a step of measuring any interference signals including any AC induction that is being presented to said control panel to monitor and analyse said interference signal and then generate an inverse signal that when injected cancels out said interference signal.

17. The false alarm reduction method, as recited in claim 10, wherein the step (a) further comprises a step of measuring any interference signals including any AC induction that is being presented to said control panel to monitor and analyse said interference signal and then generate an inverse signal that when injected cancels out said interference signal.

18. A false alarm reduction system for a security alarm system having a control panel and one or more zone detectors which are installed at different monitoring zones and electrically connected with said control panel, wherein said false alarm reduction system comprises:

means for determining whether each of said zone detectors is in a restore state or an alarm state, and means for simultaneously and independently asserting either a desired alarm state or a desired restore state to said control panel.

19. The false alarm reduction system, as recited in claim 18, wherein when each of said zone detectors is determined in said restore state, said control panel is asserted with said desired restore state, wherein when one of said zone detectors within said respective monitoring zone is determined in said alarm state every time, said control panel is asserted with said desired restore state.

20. The false alarm reduction system, as recited in claim 19, wherein when one of said other zone detectors is also determined in said alarm state within a predetermined period of time or at least one more zone detector within said respective monitoring zone is also determined in said alarm state within said predetermined period of time, said control panel is asserted with said desired alarm state for alarm response.

21. The false alarm reduction system, as recited in claim 20, further comprises wires tapping to zone inputs of said control panel for said zone detectors of said monitoring zones to form a plurality of monitoring zone loops respectively.

22. The false alarm reduction system, as recited in claim 21, further comprising a Pull-UP impedance circuit and a Pull-Down impedance circuit, said Pull-Up impedance circuit raises a loop impedance of said respective monitoring zone loop above a natural or previously present loop impedance to a desired Pull-Up set point and said Pull-Down impedance circuit lowers said loop impedance of said respective monitoring zone loop below said natural or previously present loop impedance to a desired Pull-Down set point.

* * * * *